US010435275B2

(12) United States Patent
Kimura

(10) Patent No.: US 10,435,275 B2
(45) Date of Patent: Oct. 8, 2019

(54) ELEVATOR DOOR DEVICE

(71) Applicant: MITSUBISHI ELECTRIC CORPORATION, Chiyoda-ku (JP)

(72) Inventor: Tetsuya Kimura, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 16/092,149

(22) PCT Filed: May 20, 2016

(86) PCT No.: PCT/JP2016/065015
§ 371 (c)(1),
(2) Date: Oct. 8, 2018

(87) PCT Pub. No.: WO2017/199426
PCT Pub. Date: Nov. 23, 2017

(65) Prior Publication Data

US 2019/0127183 A1 May 2, 2019

(51) Int. Cl.

| | |
|---|---|
| ***B66B 13/26*** | (2006.01) |
| ***B66B 13/14*** | (2006.01) |
| ***B66B 13/08*** | (2006.01) |
| ***B66B 13/22*** | (2006.01) |

(52) U.S. Cl.
CPC ..... *B66B 13/26* (2013.01); *B66B 13/08* (2013.01); *B66B 13/14* (2013.01); *B66B 13/22* (2013.01)

(58) Field of Classification Search
CPC ..... B66B 13/26; B66B 13/08; B66B 13/14; B66B 13/22
See application file for complete search history.

(56) References Cited

U.S. PATENT DOCUMENTS 1,568,461 A * 1/1926 McGee ..... B66B 13/08 187/318
1,655,116 A * 1/1928 Ungerer ..... B66B 13/08 187/280

(Continued)

FOREIGN PATENT DOCUMENTS

JP 61-277584 A 12/1986
JP 5-193879 A 8/1993

(Continued)

OTHER PUBLICATIONS

International Search Report dated Aug. 16, 2016 in PCT/JP2016/065015 filed May 20, 2016.

*Primary Examiner* — Michael A Riegelman
(74) *Attorney, Agent, or Firm* — Oblon, McClelland, Maier & Neustadt, L.L.P.

(57) ABSTRACT

An elevator door device includes a failure detection vane mounted on a safety shoe, and a failure detection roller to be brought into contact with the failure detection vane to turn on a shoe switch. The failure detection roller is mounted only on an OFF-failure detection floor. In a case where the shoe switch is turned off when a door is fully closed on the OFF-failure detection floor, it is determined that the safety shoe has OFF failure, and in a case where the shoe switch is turned on when the door is fully closed on an ON-failure detection floor, on which the failure detection roller is not mounted, it is determined that the safety shoe has ON failure.

6 Claims, 8 Drawing Sheets

(56) References Cited

U.S. PATENT DOCUMENTS

| | | | | | |
|---|---|---|---|---|---|
| 1,959,042 | A * | 5/1934 | Staley | B66B 13/08 | 187/315 |
| 2,053,799 | A * | 9/1936 | Mason | B66B 13/08 | 187/318 |
| 3,056,470 | A * | 10/1962 | Moser | B66B 13/22 | 187/280 |
| 5,641,951 | A * | 6/1997 | Cai | B66B 13/26 | 187/317 |
| 2009/0249697 | A1* | 10/2009 | Nabetani | B66B 13/26 | 49/324 |
| 2009/0301821 | A1* | 12/2009 | Fujiki | B66B 13/26 | 187/400 |
| 2011/0192684 | A1* | 8/2011 | Kashiwakura | B66B 13/26 | 187/317 |
| 2019/0127183 | A1* | 5/2019 | Kimura | B66B 13/14 | |

FOREIGN PATENT DOCUMENTS

| | | | |
|---|---|---|---|
| JP | 2007-182303 | A | 7/2007 |
| JP | 4770277 | B2 | 9/2011 |

* cited by examiner

ELEVATOR DOOR DEVICE

TECHNICAL FIELD

The present invention relates to an elevator door device, and more particularly, to an elevator door device capable of detecting failure of a safety shoe provided on a leading end portion of a car door of an elevator.

BACKGROUND ART

In recent years, a door configured to open and close a car doorway of an elevator includes a safety device. The safety device detects, during a door closing operation of a car door, that an obstacle such as a user of the elevator or baggage of the user is brought into contact with a leading end portion of the car door, and reverses the car door and a landing door in a door opening direction before the caught of the obstacle by the car door.

As such a safety device, for example, there is known a safety shoe. The safety shoe is provided on a side surface of the car door on the landing side so that a part thereof is protruded from the leading end portion of the car door. Further, the safety shoe is provided vertically between upper and lower sides of the car door. When the safety shoe is moved by a distance set in advance in the door opening direction of the car door due to an obstacle or other reasons, a shoe switch detects an amount of movement of the safety shoe. Then, when the amount of movement exceeds a threshold value, the car door and the landing door are reversed.

However, in some cases, operation failure occurs in the shoe switch. For example, although no obstacle is in contact with the safety shoe, the safety shoe may be erroneously detected as being moved, and the reversing operation of the car door and the landing door may be repeated. Such operation failure is hereinafter referred to as "ON failure".

Further, in contrast, when the movement of the safety shoe is not detected even though an obstacle is in contact with the safety shoe, the car door and the landing door do not perform the reversing operation. In this case, a trouble that the obstacle is caught in the door may occur. Such operation failure is hereinafter referred to as "OFF failure".

As related-art failure detection devices configured to detect the failure of the safety device, there are known, for example, Patent Literatures 1 to 3.

In Patent Literature 1, there is described a method of detecting ON failure. In Patent Literature 1, the shoe switch configured to detect the amount of movement of the safety shoe is formed of normally closed contacts. Therefore, when a door opening button is not pressed and a door closing command is ON while the door is fully opened, in a normal state, the shoe switch is closed. Meanwhile, when the shoe switch is opened, it is determined that the safety shoe has the ON failure.

Further, in Patent Literature 2, there is described a method of detecting OFF failure. In Patent Literature 2, a protruding portion is mounted on the safety shoe. The protruding portion is provided so as to be opposed to a doorstop portion of the car door. During normal operation, the protruding portion moves the safety shoe while the door is fully closed, and then the inner contacts of the shoe switch are opened. Therefore, when the inner contacts of the shoe switch are still in the closed state even while the door is fully closed, it is determined that the safety shoe has the OFF failure.

Further, in Patent Literature 3, there is proposed a method involving providing an electromagnet device for retreating the safety shoe, and causing the safety shoe to retreat during the door closing operation through control of the electromagnet device to detect the operation failure of the safety shoe. In Patent Literature 3, the electromagnet device is used to turn on or off the shoe switch at any timing.

CITATION LIST

Patent Literature

[PTL 1] JP 05-193879 A
[PTL 2] JP 2007-182303 A
[PTL 3] JP 61-277584 A

SUMMARY OF INVENTION

Technical Problem

However, in the method of detecting ON failure of Patent Literature 1, the failure is detected while the door is fully opened. Therefore, a case in which the shoe switch is activated due to failure cannot be distinguished from a case in which the shoe switch is activated when the safety shoe is pushed in by humans. Therefore, there is a problem in that, although no failure is occurring, it is erroneously detected due to human factors that the failure is occurring. In order to eliminate the human factors, the failure of the safety shoe is required to be detected at the time when the safety shoe cannot be touched, that is, while the door is fully closed.

In the method of detecting OFF failure of Patent Literature 2, the failure is detected while the door is fully closed. Therefore, the door is in a fully closed state, and the safety shoe is not pushed in by humans. Thus, the failure is not erroneously detected due to human factors. However, in the method of Patent Literature 2, the shoe switch is always activated by the protruding portion while the door is fully closed, and hence there is a problem in that, although the OFF failure of the safety shoe can be detected, the ON failure cannot be detected.

In Patent Literature 3, the safety shoe can be freely operated, and hence both of the ON failure and the OFF failure of the safety shoe can be detected while the door is fully closed. However, the electromagnet device for operating the safety shoe and a control device therefor are required to be installed, and hence there is a problem of increase in cost.

The present invention has been made to solve the above-mentioned problems, and has an object to provide an elevator door device capable of detecting OFF failure and ON failure of a safety shoe while a door is fully closed with a simple configuration and at low cost.

Solution to Problem

According to one embodiment of the present invention, there is provided an elevator door device including: a car door provided in a doorway of a car of an elevator; a safety shoe, which is provided on a leading end portion of the car door in a closing direction of the car door, and is configured to move in opening and closing directions of the car door; a shoe switch, which is provided on the car door, and is configured to detect that the safety shoe is moved by a certain distance set in advance in the opening direction of the car door; a full-closure recognition switch, which is provided in the doorway of the car, and is configured to detect that the car door is located at a fully closed position; a failure detection vane coupled to the safety shoe; a failure detection roller, which is provided on at least one of landings of the elevator, and is to be brought into contact with the failure detection vane when the car door is brought into the fully closed state to move the safety shoe by the certain distance in the opening direction of the car door; and a failure determination unit configured to determine, when the car has landed on one of the landings of the elevator, whether the full-closure recognition switch detects that the car door is located at the fully closed position and the shoe switch detects that the safety shoe is moved by the certain distance by the failure detection roller based on a result of detection by the full-closure recognition switch and a result of detection by the shoe switch, to thereby determine whether operation failure of the safety shoe has occurred.

Advantageous Effects of Invention

According to one embodiment of the present invention, with only simple change in mechanical structure, that is, by providing the failure detection vane and the failure detection roller, it is possible to provide the elevator door device capable of detecting the ON failure and the OFF failure of the safety shoe while the door is fully closed at low cost.

DESCRIPTION OF EMBODIMENTS

Elevator door devices according to embodiments of the present invention are described with reference to the drawings. Throughout the drawings, like or corresponding parts are denoted by like reference symbols. Further, description of those like or corresponding parts is not repeated, and is simplified or omitted as appropriate.

In the elevator door devices according to the embodiments of the present invention, floors of a building in which an elevator is installed are divided into an OFF-failure detection floor and an ON-failure detection floor. Then, OFF-failure detection is performed on the OFF-failure detection floor, and ON-failure detection is performed on the ON-failure detection floor. In the elevator door devices according to the embodiments of the present invention, only by adding simple members (see reference symbols 28 and 29) to a car and the OFF-failure detection floor, ON failure and OFF failure of a safety shoe can be detected under a state in which a door is fully closed. As described above, the failure detection is performed under a state in which the door is fully closed, and hence the safety shoe is not pushed in by humans. Thus, erroneous detection due to human factors does not occur.

First Embodiment

Figure 1:
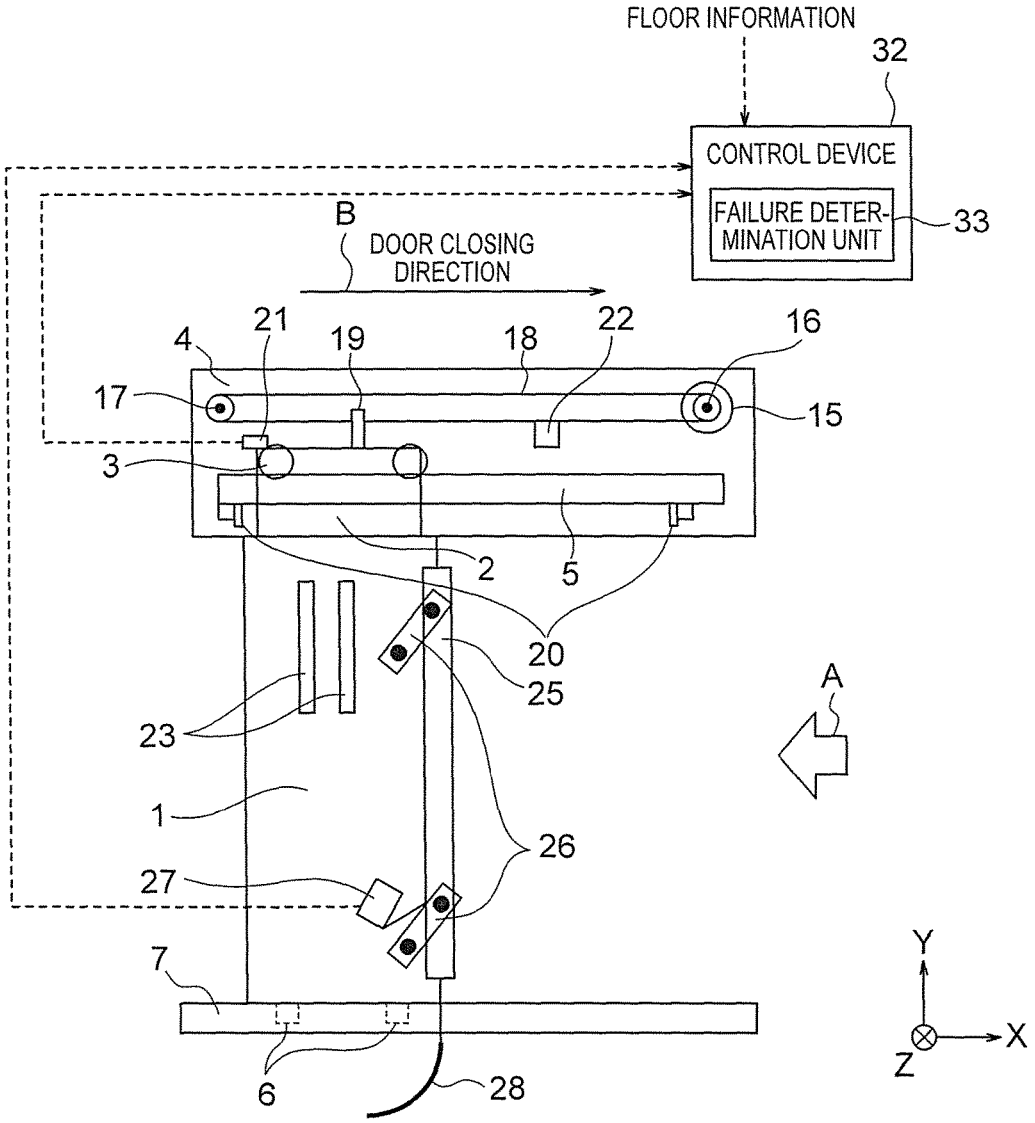
FIG. 1 is a front view for illustrating a configuration of a car door of an elevator door device according to a first embodiment of the present invention.
Figure 2:
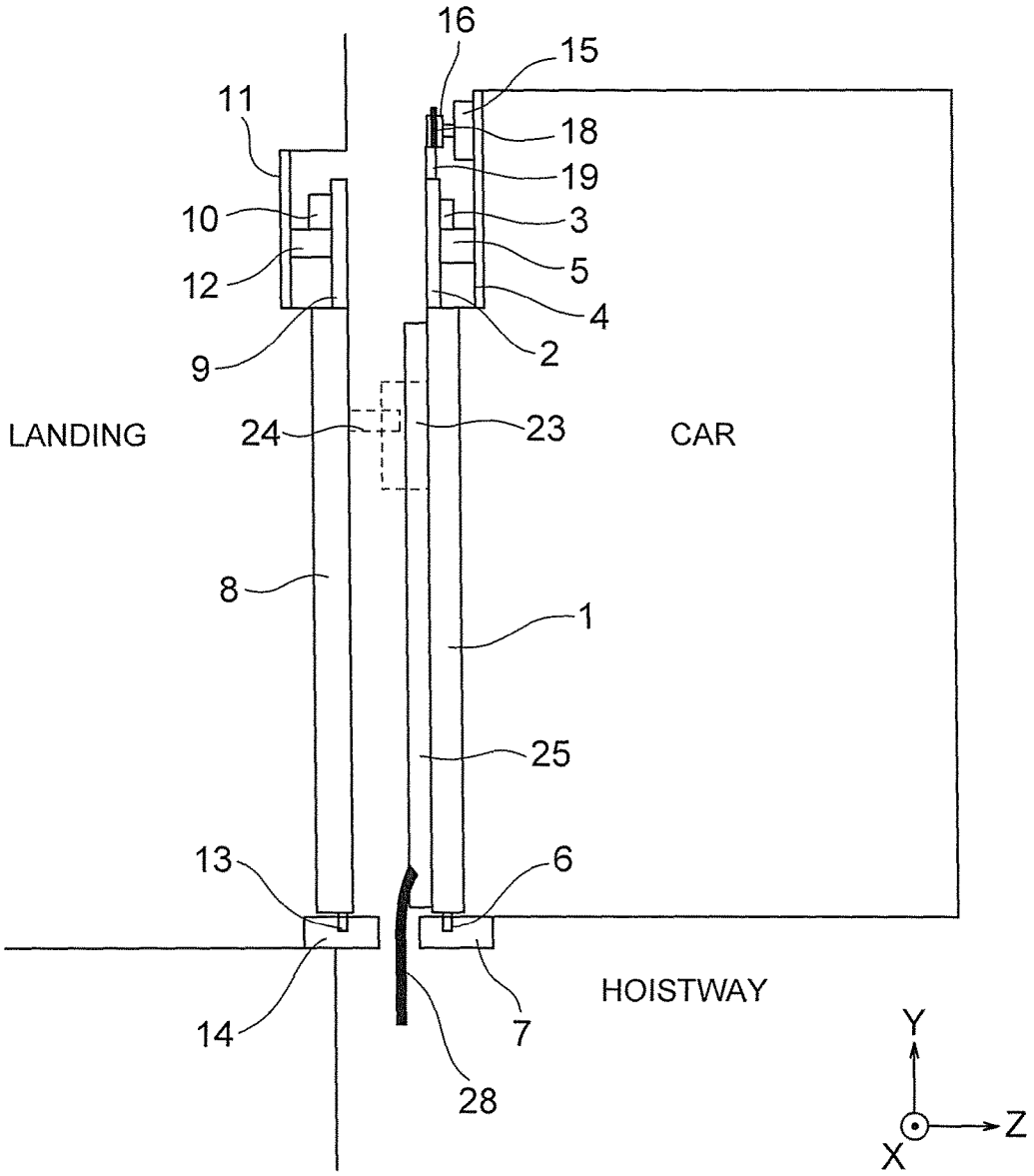
FIG. 2 is a side view for illustrating the configuration of the car door of the elevator door device according to the first embodiment of the present invention.
Figure 3:
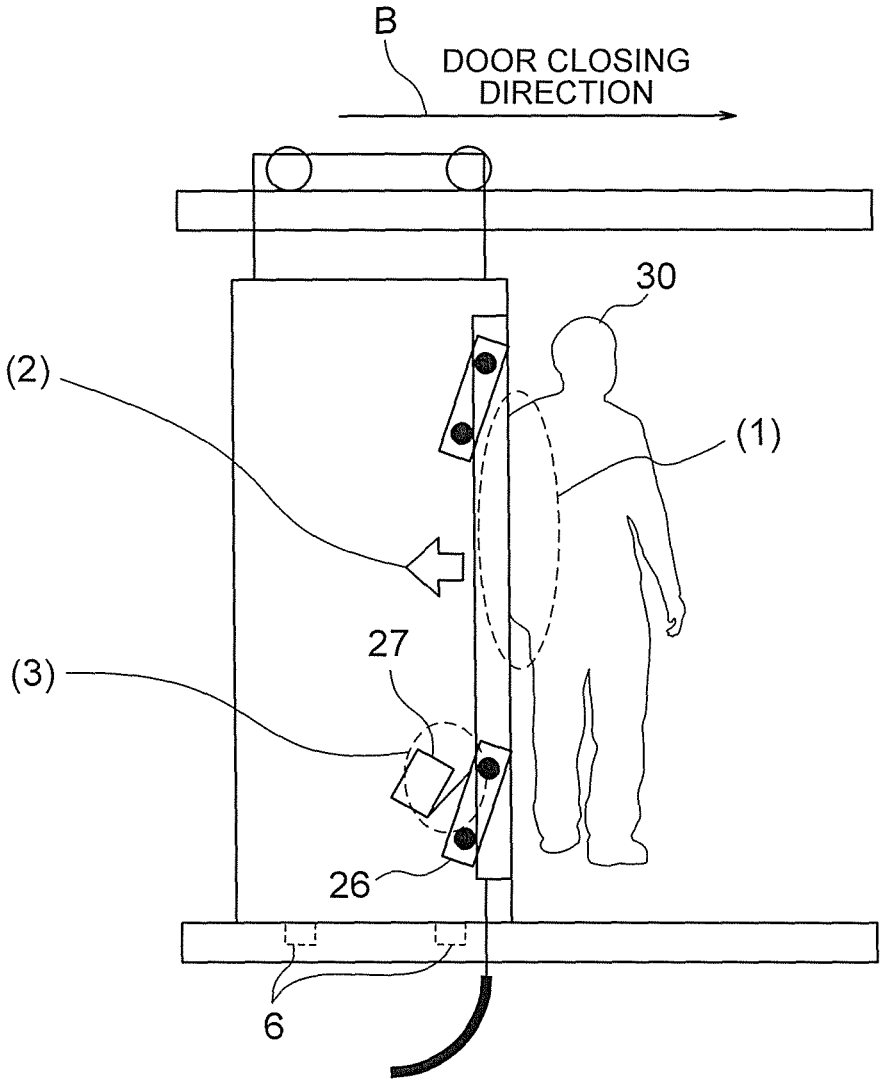
FIG. 3 is a front view for illustrating a mechanism of door catching detection of the elevator door device according to the first embodiment of the present invention.
Figure 4:
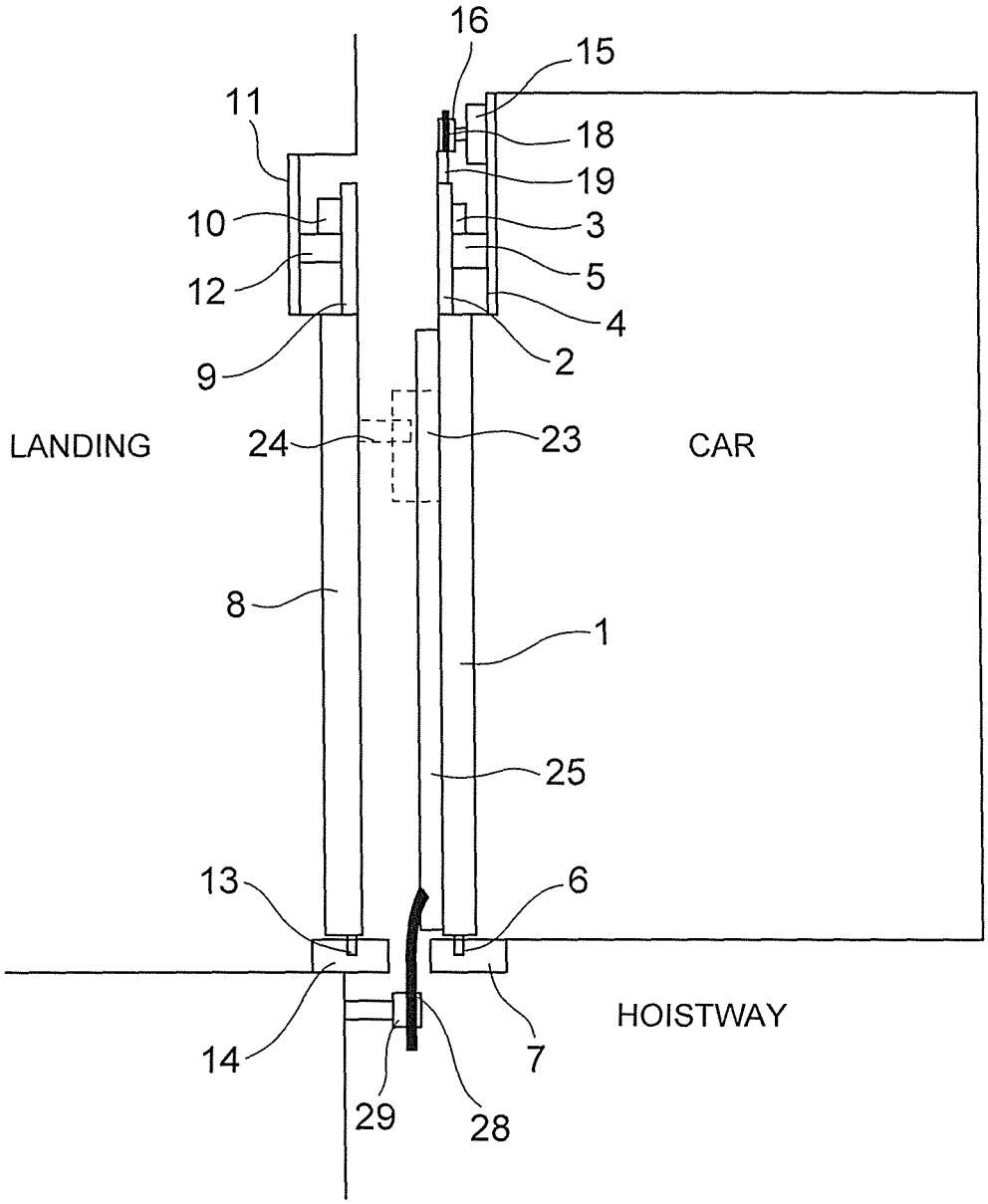
FIG. 4 is a side view for illustrating a configuration of an OFF-failure detection floor, on which the elevator door device according to the first embodiment of the present invention is provided.
Figure 5:
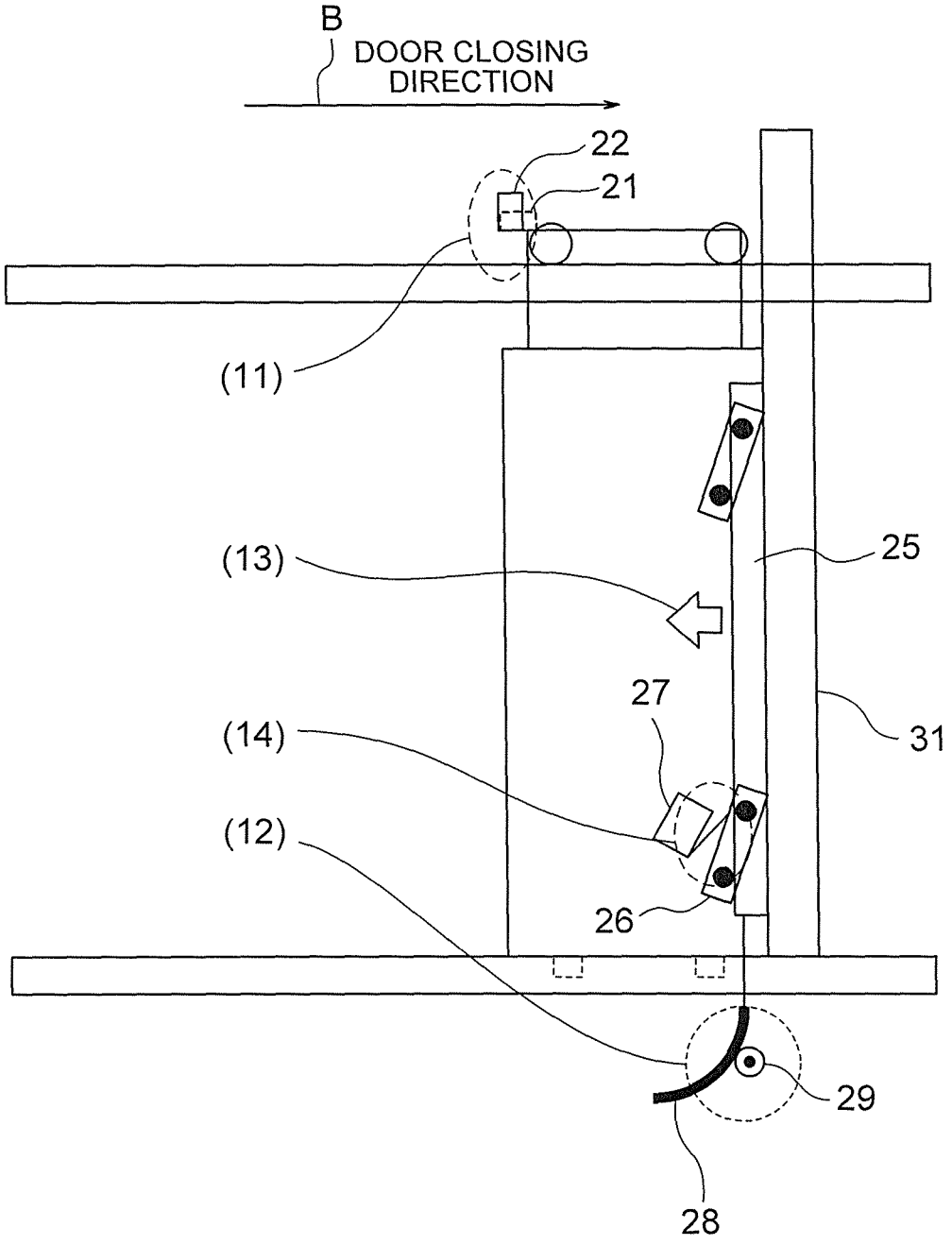
FIG. 5 is a front view for illustrating a mechanism of OFF-failure detection on the OFF-failure detection floor of the elevator door device according to the first embodiment of the present invention.
Figure 6:
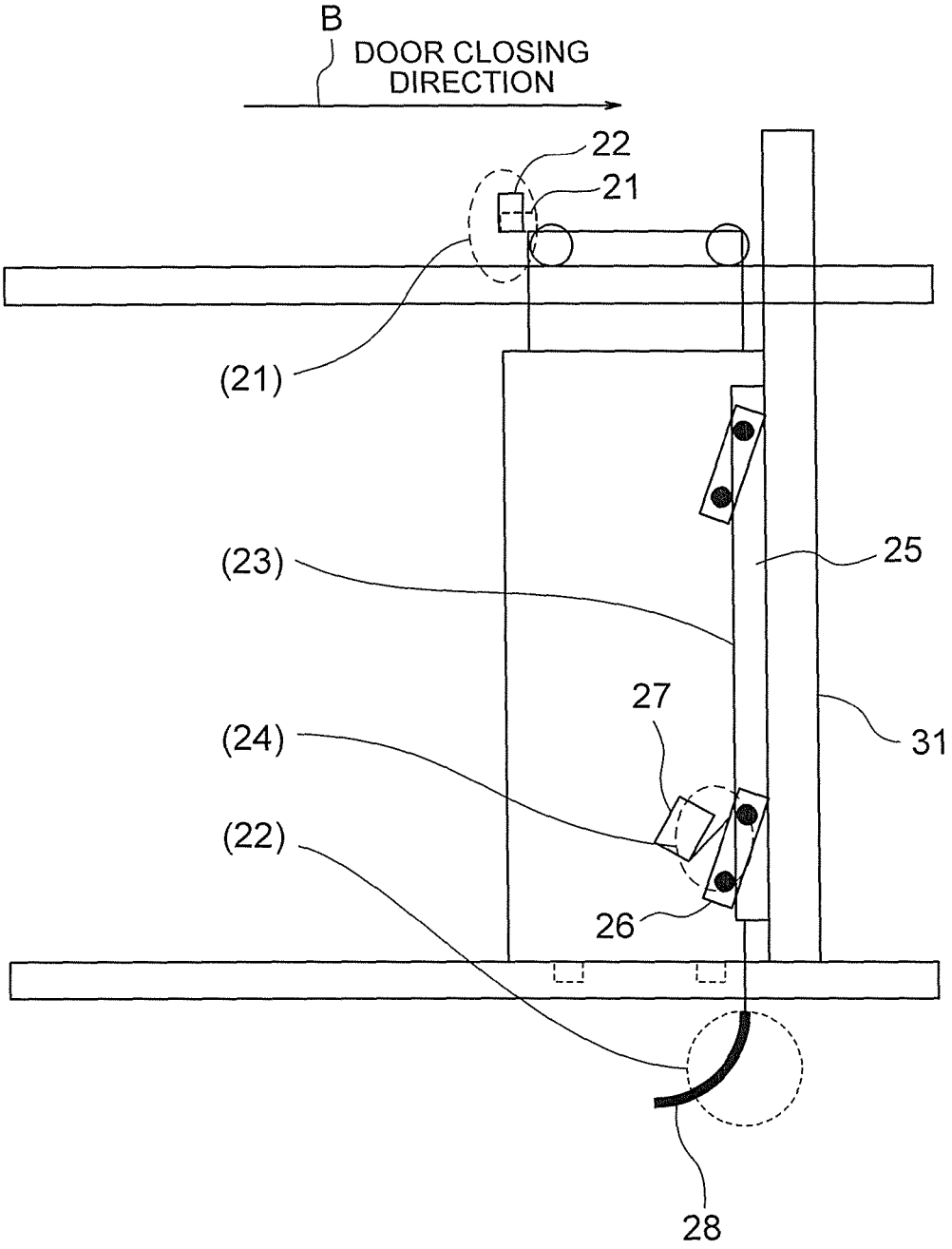
FIG. 6 is a front view for illustrating a mechanism of ON-failure detection on an ON-failure detection floor of the elevator door device according to the first embodiment of the present invention.
Figure 7:
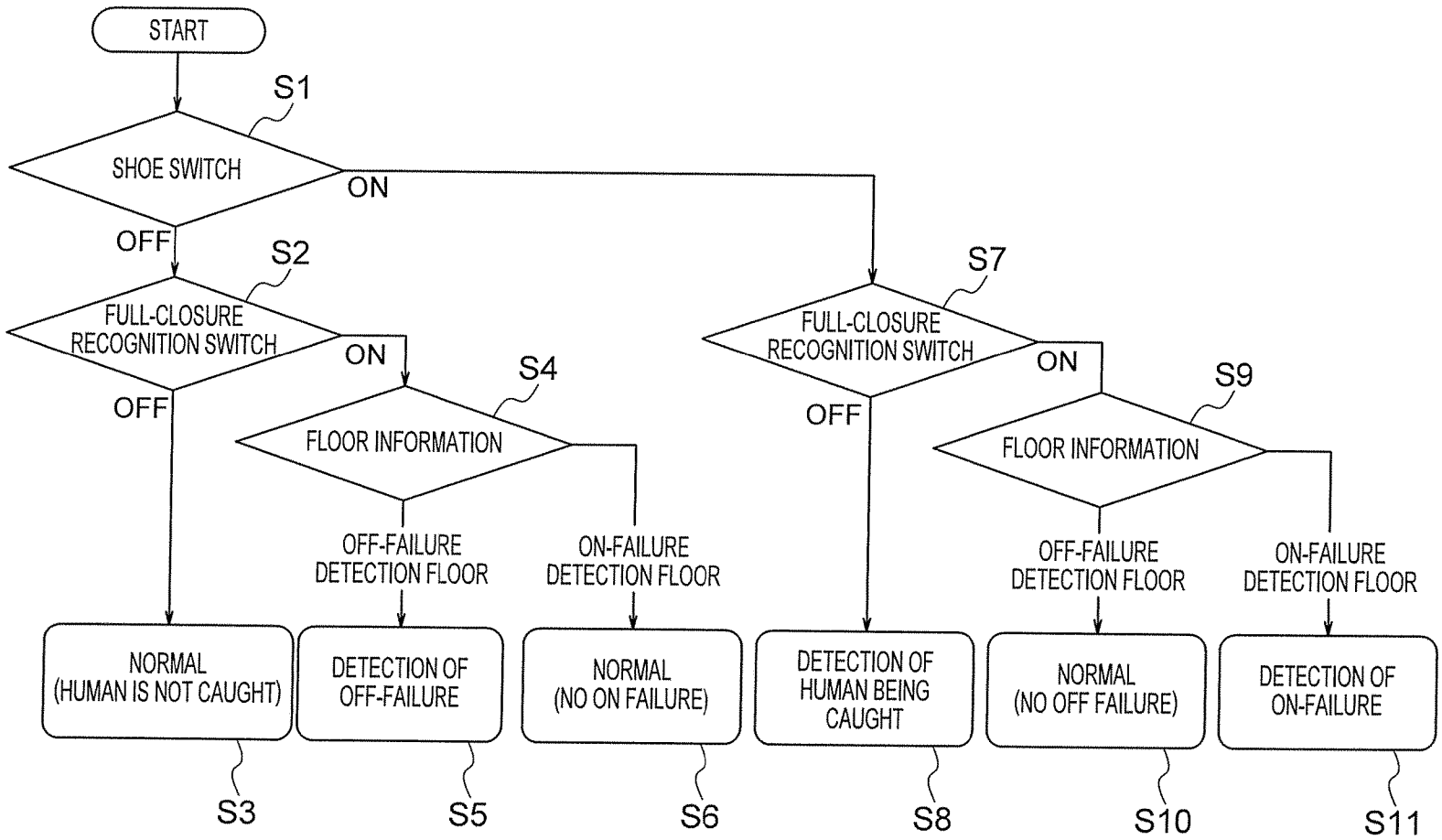
FIG. 7 is a flow chart for illustrating a flow of failure detection processing of the elevator door device according to the first embodiment of the present invention.

FIG. 1 to FIG. 7 are views for illustrating an elevator door device according to a first embodiment of the present invention. FIG. 1 is a front view for illustrating a configuration of a car door of an elevator in the first embodiment. FIG. 2 is a side view of the car door of FIG. 1. FIG. 2 is a side view for illustrating the car door illustrated in FIG. 1 from a direction of the arrow A of FIG. 1, that is, from a doorstop side. FIG. 3 is a front view for illustrating a mechanism of door catching detection in the elevator door device according to the first embodiment. FIG. 4 is a side view for illustrating a configuration of the OFF-failure detection floor in the first embodiment. FIG. 5 is a front view for illustrating a mechanism of OFF-failure detection on the OFF-failure detection floor in the first embodiment. FIG. 6 is a front view for illustrating a mechanism of ON-failure detection on the ON-failure detection floor in the first embodiment. FIG. 7 is a flow chart for illustrating a flow of failure detection processing of the elevator door device according to the first embodiment.

In FIG. 1, a car doorway is illustrated. The car doorway is an opening portion of the car of the elevator. The car of the elevator is arranged in a hoistway to be raised and lowered while carrying users, for example. As illustrated in FIG. 1, a car door panel 1 is provided in the car doorway. The car door panel 1 can be freely opened and closed in a horizontal direction. In FIG. 1, the horizontal direction corresponds to an X-axis direction. Further, the arrow B in FIG. 1 indicates a door closing direction. In FIG. 1, only one car door panel 1 is illustrated, but a plurality of car door panels 1 may be provided. A car door hanger 2 is mounted on an upper end portion of the car door panel 1. Further, one or more car door rollers 3 are rotatably and axially supported at an upper portion of the car door hanger 2. In FIG. 1, two car door rollers 3 are provided, but the number of the car door rollers 3 is not limited thereto.

Above the car doorway, a car girder 4 is provided. A car door rail 5 is mounted on the car girder 4 along opening and closing directions of the car door panel 1, that is, in the horizontal direction. The car door rollers 3 are engaged with an upper end of the car door rail 5. The car door panel 1 is hung by the car door rail 5 through intermediation of the car door hanger 2 and the car door rollers 3. The car door rollers 3 are rolled and guided by the car door rail 5 so that the car door panel 1 opens and closes the car doorway.

Further, car door shoes 6 are mounted on a lower end of the car door panel 1. Meanwhile, a car door sill 7 is mounted at a lower portion of the car doorway. The car door sill 7 has a groove formed therein. The car door shoes 6 are fitted into the groove of the car door sill 7 to be moved while being guided by the groove. The car door shoes 6 and the groove of the car door sill 7 prevent the car door panel 1 from moving in a depth direction (Z-axis direction). The members 1 to 7 provided in the car doorway construct a "car door" provided in the car doorway of the elevator.

FIG. 2 is a side view for illustrating the car doorway of FIG. 1 as viewed from the direction of the arrow A of FIG. 1, that is, from the doorstop side. In FIG. 2, a landing doorway is also illustrated. A configuration of the landing doorway is similar to the above-mentioned configuration of the car doorway. That is, members 8 to 14 corresponding to the members 1 to 7 provided in the car doorway, respectively, are provided in the landing doorway. The members 8 to 14 provided in the landing doorway construct a "landing door" provided in the landing doorway. The front view of the landing doorway is omitted, but is similar to that of the configuration of the car doorway, and hence FIG. 1 is to be referred to together with FIG. 2. Now, description is given of those members 8 to 14.

As illustrated in FIG. 2, a landing door panel 8 is provided in the landing doorway. The landing door panel 8 can be freely opened and closed in the horizontal direction. The number of the landing door panels 8 is the same as the number of the car door panels 1. A landing door hanger 9 is mounted on an upper end portion of the landing door panel 8. Further, one or more landing door rollers 10 are rotatably and axially supported at an upper portion of the landing door hanger 9. In FIG. 2, two landing door rollers 10 are provided.

Above the landing doorway, a landing girder 11 is provided. A landing door rail 12 is mounted on the landing girder 11 along opening and closing directions of the landing door panel 8, that is, in the horizontal direction. The landing door rollers 10 are rotatably engaged with an upper end of the landing door rail 12. The landing door panel 8 is hung by the landing door rail 12 through intermediation of the landing door hanger 9 and the landing door rollers 10. The landing door rollers 10 are rolled and guided by the landing door rail 12 so that the landing door panel 8 opens and closes the landing doorway.

Further, landing door shoes 13 are mounted on a lower end of the landing door panel 8. Meanwhile, a landing door sill 14 is mounted at a lower portion of the landing doorway. The landing door sill 14 has a groove formed therein. The landing door shoes 13 are fitted into the groove of the landing door sill 14 to be moved while being guided by the groove. The landing door shoes 13 and the groove of the landing door sill 14 prevent the landing door panel 8 from moving in the depth direction (Z-axis direction).

The opening and closing operations of the car door panel 1 are performed by a door drive device arranged above the door rail 5 on the car girder 4. The door drive device includes a door motor 15. The door drive device is provided only on the car door side, and is not provided on the landing door side. As illustrated in FIG. 1, the door motor 15 is provided on one side of the car girder 4 in the horizontal direction. In FIG. 1, the door motor 15 is provided on the right side of the car girder 4 in the horizontal direction. A drive wheel 16 is fixed to a rotary shaft of the door motor 15.

Further, a driven wheel 17 is freely rotatably mounted on the other side of the car girder 4 in the horizontal direction. That is, in FIG. 1, the driven wheel 17 is provided on the left side of the car girder 4 in the horizontal direction. The driven wheel 17 is provided so as to correspond to the drive wheel 16. The driven wheel 17 and the drive wheel 16 are mounted at the same height. An endless toothed belt 18 is wrapped around the drive wheel 16 and the driven wheel 17.

Teeth are formed on an inner side of the toothed belt 18 by forming protrusions and recesses at equal intervals. The drive wheel 16 and the driven wheel 17 have protrusions and recesses formed so as to be engaged with those teeth. In this manner, the teeth of the toothed belt 18 are engaged with the protrusions and the recesses of the drive wheel 16 and the driven wheel 17 so that the rotational drive of the door motor 15 is transmitted to the circulation movement of the toothed belt 18. This mechanism is referred as "wrapping transmission mechanism". As described above, the door drive device for the elevator in the first embodiment constructs a door drive device of the wrapping transmission mechanism.

As illustrated in FIG. 1, a locking member 19 is mounted on an upper end of the car door hanger 2 on the car door panel 1. The locking member 19 is locked to a lower side of the toothed belt 18. In this manner, the toothed belt 18 and the car door panel 1 are operated in association with each other through intermediation of the locking member 19. The rotational drive of the door motor 15 in both forward and reverse directions is converted into the circulation movement of the toothed belt 18 in both directions. Therefore, when the door motor 15 is rotated, the toothed belt 18 moves to circulate along therewith. As a result, the car door panel 1 is horizontally moved to open and close the car doorway.

Further, a pair of stoppers 20 is provided on the car girder 4. Those stoppers 20 are provided at both ends of the car girder 4 in the horizontal direction, respectively. The stoppers 20 restrict the movement of the car door panel 1 beyond a fully opened position and a fully closed position. Therefore, those stoppers 20 are arranged so that one end portion and another end portion of the car door hanger 2 abut against one of the stoppers 20 when the door panel 1 is in a fully opened state and a fully closed state, respectively.

A full-closure recognition switch 21 is mounted on the car girder 4 at a position above the car door hanger 2. The full-closure recognition switch 21 has a U-shape in cross section. Meanwhile, a blocking plate 22 is mounted on the upper end portion of the car door hanger 2. The blocking plate 22 has an outer shape that is complementary to the inner shape of the U-shape of the full-closure recognition switch 21. At the time of the door closing operation of the car door panel 1, along with the movement of the car door panel 1, the blocking plate 22 is inserted to the inner side of the U-shape of the full-closure recognition switch 21. The blocking plate 22 is arranged so that, when the car door panel 1 is in the fully closed state, the blocking plate 22 is positioned right inside the U-shape of the full-closure recognition switch 21. On the inner side of the full-closure recognition switch 21, a light emitting element and a light receiving element are provided so as to be opposed to each other. When the blocking plate 22 is absent, light emitted from the light emitting element is received by the light receiving element. The full-closure recognition switch 21 detects that, when the light receiving element receives the light, the car door panel 1 is not in the fully closed state. Meanwhile, when the blocking plate 22 is positioned on the inner side of the U-shape of the full-closure recognition switch 21, the light emitted from the light emitting element is blocked by the blocking plate 22, and hence the light is not received by the light receiving element. The full-closure recognition switch 21 detects that, when the light receiving element does not receive the light, the car door panel 1 is in the fully closed state.

In this manner, when the full-closure recognition switch 21 detects that the blocking plate 22 is positioned on the inner side of the U-shape, the full-closure recognition switch 21 outputs a full-closure signal. That is, the full-closure recognition switch 21 constructs a full-closure detection unit configured to detect that the car door panel 1 is located at a full-closure position.

As described above, the door drive device is provided only on the car door side, and is not provided on the landing door side. Specifically, members corresponding to the above-mentioned members 16 to 19 provided on the car doorway side are not provided on the landing doorway side.

Therefore, the landing door panel 8 is also driven by the door drive device provided on the car door panel 1 side. That is, the landing door panel 8 is engaged with the car door panel 1 by an engaging member to be opened and closed in synchronization with the car door panel 1. The engaging member is constructed of engaging vanes 23 and an engaging roller 24 illustrated in FIG. 2. The engaging vanes 23 are mounted on the car door panel 1. The engaging roller 24 is mounted on the landing door panel 8. When the car lands on a stop floor, the engaging vanes 23 mounted on the car door panel 1 hold the engaging roller 24 on the landing door panel 8 so that the car door panel 1 and the landing door panel 8 are engaged with each other. In this manner, the motive power of the door drive device provided on the car door side is transmitted also to the landing door side so that the car doorway and the landing doorway are opened and closed in association with each other.

Further, as illustrated in FIG. 1, a safety shoe 25 is provided vertically (in a Y-axis direction of FIG. 1) at a leading end portion of the car door panel 1 in the door closing direction. The safety shoe 25 is provided along substantially the entire length of the car door panel 1. The safety shoe 25 is arranged so that its leading end portion is protruded from the leading end portion of the car door panel 1 by a certain distance set in advance toward the doorstop portion side of the car. Further, links 26 are freely rotatably provided on a side surface of the car door panel 1 on the landing side. The safety shoe 25 is supported by the links 26 so as to be freely advanced and retreated by a distance set in advance in the opening and closing directions of the car door panel 1. That is, at the time of the door closing operation of the car door panel 1, when an obstacle is brought into contact with the leading end portion of the safety shoe 25 and the safety shoe 25 is urged in the door opening direction, the links 26 are rotated counterclockwise in FIG. 1. In this manner, the safety shoe 25 is moved in the door opening direction with respect to the car door panel 1.

Further, a shoe switch 27 is provided on the side surface of the car door panel 1 on the landing side. The shoe switch 27 detects that the safety shoe 25 is moved with respect to the car door panel 1 by a distance set in advance in the door opening direction. The shoe switch 27 includes a detecting element. The detecting element of the shoe switch 27 is engaged with the link 26. The shoe switch 27 is configured such that the inner contacts are turned on or off depending on the position of the detecting element. When the safety shoe 25 is urged in the door opening direction, the links 26 rotate counterclockwise in FIG. 1. With the rotation of the links 26, the detecting element of the shoe switch 27 engaged with the link 26 is pushed in. When the amount of rotation of the link 26 exceeds a threshold value, that is, when the safety shoe 25 is moved with respect to the car door panel 1 by the distance set in advance in the door opening direction, the inner contacts of the shoe switch 27 are switched from OFF to ON. This operation is described with reference to FIG. 3. In FIG. 3, first, as indicated by reference symbol (1), a passenger comes into contact with the safety shoe 25. In this case, as indicated by reference symbol (2), the safety shoe 25 is moved in the door opening direction. As a result, as indicated by reference symbol (3), the shoe switch 27 is turned on. As described above, the safety shoe 25, the links 26, and the shoe switch 27 play a role as a safety device.

In the first embodiment, as illustrated in FIG. 1, a failure detection vane 28 is coupled to a lower end of the safety shoe 25. As illustrated in FIG. 2, the failure detection vane 28 is mounted so as to pass through a gap between the car door sill 7 and the landing door sill 14. Therefore, when the car is raised and lowered, the failure detection vane 28 does not come into contact with each device provided on the landing side.

FIG. 4 is a side view for illustrating the bottom floor of the building from the direction of the doorstop side. As illustrated in FIG. 4, on the bottom floor, a failure detection roller 29 is mounted at a landing lower portion so as to protrude into the hoistway. The failure detection roller 29 is mounted so as to be brought into contact with the failure detection vane 28 on the car side when the car lands on the bottom floor and the door is in the fully closed state. FIG. 4 is an illustration of a state in which the failure detection roller 29 and the failure detection vane 28 are in contact with each other. The floor on which the failure detection roller 29 is mounted is hereinafter referred to as "OFF-failure detection floor". That is, in the first embodiment, the bottom floor of the building is the OFF-failure detection floor.

Next, with reference to FIG. 5, description is given of a mechanism of OFF-failure detection on the OFF-failure detection floor of the elevator door device according to the first embodiment. It is assumed that, as illustrated in FIG. 5, the elevator has now landed on the bottom floor, and the door is in the fully closed state. When the door is in the fully closed state, as indicated by reference symbol (11), the blocking plate 22 blocks the full-closure recognition switch 21, and hence the full-closure recognition switch 21 detects that the door is in the fully closed state. Further, at this time, as indicated by reference symbol (12), the failure detection vane 28 is in contact with the failure detection roller 29. As described above, the failure detection vane 28 is mounted on the safety shoe 25. Therefore, when the failure detection vane 28 is brought into contact with the failure detection roller 29 and the failure detection vane 28 is pressed by the failure detection roller 29, along therewith, as indicated by reference symbol (13), the safety shoe 25 is urged in the door opening direction. At this time, in a normal state, as indicated by reference symbol (14), the safety shoe 25 is moved with respect to the car door panel 1 in the door opening direction to turn on the shoe switch 27 through intermediation of the link 26. Meanwhile, when the shoe switch 27 is not turned on, the shoe switch has the OFF failure. Therefore, in a case where the shoe switch 27 is in the OFF state when the car has landed on the bottom floor and the door is in the fully closed state, it can be determined that the shoe switch has the OFF failure. In this method of mounting the failure detection roller 29 at the landing lower portion, when the failure detection roller 29 is mounted on a landing lower portion of a floor other than the bottom floor, the failure detection roller 29 and the failure detection vane 28 are brought into contact with each other while the car passes the floor, and thus abnormal noise and breakage may occur. Therefore, only the bottom floor can be set as the OFF-failure detection floor.

Next, with reference to FIG. 6, description is given of a mechanism of ON-failure detection on the ON-failure detection floor of the elevator door device according to the first embodiment. In the first embodiment, as described above, the failure detection roller 29 is not mounted on the landing lower portion of a floor other than the bottom floor. Therefore, the configuration of the floor other than the bottom floor is equal to that of FIG. 1 as illustrated in FIG. 6. A floor on which the failure detection roller is not mounted is hereinafter referred to as "ON-failure detection floor". That is, in the first embodiment, each floor other than the bottom floor of the building is the ON-failure detection floor. It is assumed that, as illustrated in FIG. 6, the elevator has now landed on a floor other than the bottom floor, and the door is in the fully closed state. When the door is in the fully closed state, the blocking plate 22 blocks the full-closure recognition switch 21, and hence, as indicated by reference symbol (21), the full-closure recognition switch 21 can detect that the door is in the fully closed state. Further, on the ON-failure detection floor, as indicated by reference symbol (22), the failure detection roller 29 is not provided. Therefore, the failure detection vane 28 is not in contact with the failure detection roller 29. Therefore, in a normal state, as indicated by reference symbol (23), the safety shoe 25 is not moved with respect to the car door panel 1 in the door opening direction. Therefore, as indicated by reference symbol (24), the shoe switch 27 remains in the OFF state. Therefore, in a case where the shoe switch 27 is in the ON state when the car has landed on the floor other than the bottom floor and the door is in the fully closed state, it can be determined that the shoe switch has the ON failure.

FIG. 7 is an illustration of a flow of processing of detecting the ON failure and the OFF failure in the elevator door device according to the first embodiment. The elevator door device according to the first embodiment includes a control device 32 as illustrated in FIG. 1. The flow of FIG. 7 is performed by a failure determination unit 33 provided in the control device 32. The control device 32 is constructed of, for example, a personal computer. The control device 32 includes an input device, to which a signal is to be input from the outside, a processor configured to perform calculation processing, a memory configured to store various types of data and programs, and an output device configured to output a signal to the outside. The failure determination unit 33 is implemented by the processor executing the program stored in the memory. Further, a plurality of processors and a plurality of memories may cooperate with each other to execute the function of the failure determination unit 33.

To the failure determination unit 33, information from the shoe switch 27, information from the full-closure recognition switch 21, and floor information from an elevator control panel (not shown) are input. The failure determination unit 33 determines whether or not the ON failure or the OFF failure of the safety shoe has occurred based on those signals.

In this case, the shoe switch 27 outputs an ON signal when the shoe switch 27 is in the ON state, and outputs an OFF signal when the shoe switch 27 is in the OFF state. Therefore, the above-mentioned information from the shoe switch 27 is any one of the ON signal and the OFF signal.

Further, the full-closure recognition switch 21 outputs an ON signal when the car door panel 1 is in the fully closed state, and outputs nothing or an OFF signal when the car door panel 1 is not fully closed. The information from the full-closure recognition switch 21 is a signal indicating whether or not the car door panel 1 is fully closed.

Further, the floor signal from the elevator control panel is information indicating on which floor the car is stopping now. The elevator control panel is a device configured to control the operation of the car, and is provided in a machine room provided in an upper portion of the hoistway. The failure determination unit 33 stores in advance in the memory a table for determining whether each floor is the ON-failure detection floor or the OFF-failure detection floor. Therefore, when the information on the stop floor of the car is input from the elevator control panel, it can be determined based on the information whether the stop floor is the ON-failure detection floor or the OFF-failure detection floor.

As illustrated in FIG. 7, in Step S1, the failure determination unit 33 determines whether the information from the shoe switch 27 is the ON signal or the OFF signal. When the information from the shoe switch 27 is the ON signal, the processing proceeds to Step S7, and when the information from the shoe switch 27 is the OFF signal, the processing proceeds to Step S2.

In Step S2, the failure determination unit 33 determines whether or not the car door panel 1 is fully closed based on the information from the full-closure recognition switch 21. When the car door panel 1 is fully closed, the processing proceeds to Step S4, and otherwise, the processing proceeds to Step S3.

In Step S3, the failure determination unit 33 determines that the operation of the safety shoe is normal.

In Step S4, the failure determination unit 33 determines based on the floor information from the elevator control panel whether the current stop floor of the car is the OFF-failure detection floor or the ON-failure detection floor. When the current stop floor of the car is the OFF-failure detection floor, the processing proceeds to Step S5, and when the current stop floor of the car is the ON-failure detection floor, the processing proceeds to Step S6.

In Step S5, the failure determination unit 33 determines that the operation of the safety shoe has the OFF failure. On the OFF-failure detection floor, as described above, the failure detection roller 29 is provided, and hence when the car door panel 1 is in the fully closed state, the shoe switch 27 is supposed to be in the ON state. However, in this case, the shoe switch 27 is in the OFF state, and hence the failure determination unit 33 determines that the operation of the safety shoe has the OFF failure.

In Step S6, the failure determination unit 33 determines that the operation of the safety shoe is normal. On the ON-failure detection floor, as described above, the failure detection roller 29 is not provided, and hence the shoe switch 27 is supposed to remain in the OFF state even when the car door panel 1 is in the fully closed state. In this case, the shoe switch 27 is in the OFF state, and hence the failure determination unit 33 determines that the operation of the safety shoe is normal.

In Step S7, the failure determination unit 33 determines based on the information from the full-closure recognition switch 21 whether or not the car door panel 1 is fully closed. When the car door panel 1 is fully closed, the processing proceeds to Step S9, and otherwise, the processing proceeds to Step S8.

In Step S8, the failure determination unit 33 determines that an obstacle is present.

In Step S9, the failure determination unit 33 determines based on the floor information from the elevator control panel whether the current stop floor of the car is the OFF-failure detection floor or the ON-failure detection floor. When the current stop floor of the car is the OFF-failure detection floor, the processing proceeds to Step S10, and when the current stop floor of the car is the ON-failure detection floor, the processing proceeds to Step S11.

In Step S10, the failure determination unit 33 determines that the operation of the safety shoe is normal. On the OFF-failure detection floor, as described above, the failure detection roller 29 is provided, and hence when the car door panel 1 is in the fully closed state, the shoe switch 27 is supposed to be in the ON state. However, in this case, the shoe switch 27 is in the ON state, and hence the failure determination unit 33 determines that the operation of the safety shoe is normal.

In Step S11, the failure determination unit 33 determines that the operation of the safety shoe has the ON failure. On the ON-failure detection floor, as described above, the failure detection roller 29 is not provided, and hence the shoe switch 27 is supposed to remain in the OFF state even when the car door panel 1 is in the fully closed state. In this case, the shoe switch 27 is in the ON state, and hence the failure determination unit 33 determines that the operation of the safety shoe has the ON failure.

As described above, in the first embodiment, the elevator door device includes: the car door panel 1 provided in the doorway of the car of the elevator; the safety shoe 25, which is provided on the leading end portion of the car door panel 1 in the closing direction of the car door panel 1, and is configured to move in the opening and closing directions of the car door; the shoe switch 27, which is provided on the car door panel 1, and is configured to be activated when the safety shoe 25 is moved by a certain distance set in advance in the opening direction of the car door; the full-closure recognition switch 21, which is provided in the doorway of the car, and is configured to detect that the car door is brought into the fully closed state; the failure detection vane 28 coupled to the safety shoe 25; the failure detection roller 29, which is provided on at least one of the landings of the elevator, and is to be brought into contact with the failure detection vane 28 when the car door is brought into the fully closed state to move the safety shoe 25 by a certain distance in the opening direction of the car door; and the failure determination unit 33 configured to determine whether the operation failure of the safety shoe 25 has occurred based on the result of detection by the full-closure recognition switch 21 and on whether the shoe switch 27 is activated when the car has landed on one of the landings of the elevator. The failure determination unit 33 sets a floor of the landing in which the failure detection roller 29 is mounted as the OFF-failure detection floor for detecting the OFF failure of the safety shoe 25, and sets a floor of the landing in which the failure detection roller 29 is not mounted as the ON-failure detection floor for detecting the ON failure of the safety shoe 25. When the car has landed on the OFF-failure detection floor, the failure determination unit 33 detects whether the safety shoe 25 has the OFF failure, and when the car has landed on the ON-failure detection floor, the failure determination unit 33 detects whether the safety shoe 25 has the ON failure. In the first embodiment, the floors of the building are divided into the OFF-failure detection floor and the ON-failure detection floor, the failure detection vane 28 is added to the car, and the failure detection roller 29 is added to the OFF-failure detection floor. With such a simple change in configuration, the OFF failure and the ON failure of the safety shoe can be detected under a state in which the door is fully closed at low cost.

Further, in the first embodiment, when the car lands on the OFF-failure detection floor, in a case where the full-closure recognition switch 21 detects that the car door is located at a fully closed position and the shoe switch 27 is not activated, the failure determination unit 33 determines that the safety shoe 25 has the OFF failure. That is, when the shoe switch 27 is not activated even though the failure detection roller 29 presses the safety shoe 25 through intermediation of the failure detection vane 28, the OFF failure is detected. Therefore, the OFF failure can be detected quickly and reliably.

Further, in the first embodiment, when the car lands on the ON-failure detection floor, in a case where the full-closure recognition switch 21 detects that the car door is located at a fully closed position and the shoe switch 27 is activated, the failure determination unit 33 determines that the safety shoe 25 has the ON failure. That is, the failure detection roller 29 is not provided on the ON-failure detection floor, and hence when the shoe switch 27 is activated even though the safety shoe 25 is not pressed, the ON failure is detected. Therefore, the ON failure can be detected quickly and reliably. In the first embodiment, the ON-failure detection is performed when the door is in the fully closed state, and hence erroneous detection due to human factors is eliminated. Thus, the ON-failure detection can be performed with high accuracy.

Further, in the first embodiment, the bottom floor is set as the OFF-failure detection floor. When the failure detection roller 29 is mounted on a landing lower portion of a floor other than the bottom floor, the failure detection roller 29 and the failure detection vane 28 are brought into contact with each other while the car passes the floor, and thus abnormal noise and breakage may occur. However, in the first embodiment, the failure detection roller 29 is provided on the bottom floor, and hence the abnormal noise and the breakage do not occur. Further, in general, the bottom floor has an entrance of a building, and hence users of the elevator most frequently use the bottom floor. Therefore, the frequency at which the elevator lands on the bottom floor is higher than the frequency at which the elevator lands on other floors. In the first embodiment, only the bottom floor is set as the OFF-failure detection floor, and all of the other floors are set as the ON-failure detection floor, and hence the number of the ON-failure detection floors is greatly larger than the number of the OFF-failure detection floors. However, the bottom floor having a high landing frequency is set as the OFF-failure detection floor, and hence the number of times to execute the OFF-failure detection can be ensured as appropriate.

Second Embodiment

Figure 8:
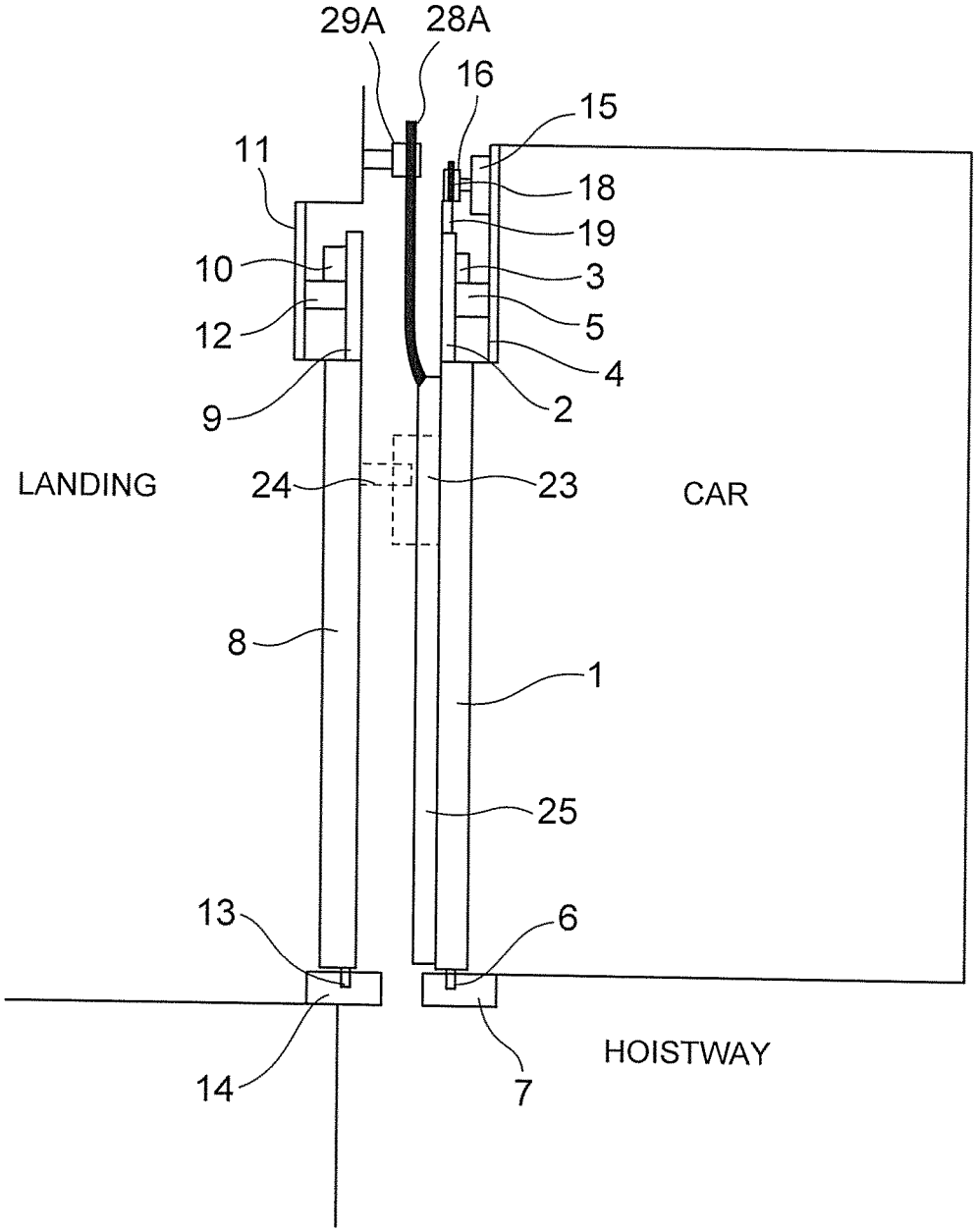
FIG. 8 is a side view for illustrating a configuration of an OFF-failure detection floor of an elevator door device according to each of a second embodiment and a third embodiment of the present invention.

FIG. 8 is a side view for illustrating a configuration of an elevator door device according to a second embodiment of the present invention. FIG. 8 is an illustration of the configuration of the OFF-failure detection floor. FIG. 8 differs from FIG. 4 referred to above in that the OFF-failure detection floor is provided in the top floor of the building. Further, in FIG. 8, a failure detection vane 28A is mounted upward from an upper end of the safety shoe 25. At this time, the failure detection vane 28A is arranged between the car door hanger 2 and the landing door hanger 9 so as not to be brought into contact with those hangers. Further, in FIG. 8, a failure detection roller 29A is mounted on an upper portion of the landing so as to protrude into the hoistway. The mechanism of failure detection is the same as that in the first embodiment.

That is, it is assumed that, as illustrated in FIG. 8, the elevator has now landed on the top floor, and the door is in the fully closed state. At this time, the failure detection vane 28A is in contact with the failure detection roller 29A. The failure detection vane 28A is mounted on the safety shoe 25 as described above. Therefore, when the failure detection vane 28A is brought into contact with the failure detection roller 29A and the failure detection vane 28A is pressed by the failure detection roller 29A, the safety shoe 25 is urged in the door opening direction along therewith. At this time, when it is normal, the safety shoe 25 is moved with respect to the car door panel 1 in the door opening direction to turn on the shoe switch 27 through intermediation of the link 26. In FIG. 8, illustration of the links 26 and the shoe switch 27 is omitted, but in actuality, the links 26 and the shoe switch 27 are provided also in FIG. 8 similarly to FIG. 4.

In the second embodiment, the top floor can be set as the OFF-failure detection floor, and hence the second embodiment is effective when, for example, the failure detection roller 29 cannot be mounted on the lower portion of the landing of the bottom floor or when the frequency of landing to the bottom floor is low.

As described above, also in the second embodiment, an effect similar to that of the above-mentioned first embodiment can be obtained. Further, in the second embodiment, the top floor can be set as the OFF-failure detection floor, and hence the second embodiment is effective when, for example, the failure detection roller 29 cannot be mounted on the lower portion of the landing of the bottom floor or when the frequency of landing to the bottom floor is low.

Third Embodiment

Both of the bottom floor and the top floor can be set as the OFF-failure detection floor. In this case, the failure detection vane 28 is mounted on the upper end of the safety shoe 25, and the failure detection vane 28A is mounted on the lower end of the safety shoe 25. Further, along therewith, the failure detection roller 29 is mounted on the lower portion of the landing of the bottom floor so as to protrude into the hoistway, and the failure detection roller 29A is mounted on the upper portion of the landing of the top floor so as to protrude into the hoistway. The mechanism of failure detection is the same as those in the first embodiment and the second embodiment, and hence the description thereof is omitted herein.

As described above, also in the third embodiment, an effect similar to those in the above-mentioned first and second embodiments can be obtained. Further, in the third embodiment, the bottom floor and the top floor can be set as the OFF-failure detection floor. Therefore, even when the frequency of landing to the bottom floor and the top floor is low, the OFF-failure detection can be performed on both of the bottom floor and the top floor, and hence reduction in frequency of executing the OFF-failure detection can be prevented.

The invention claimed is:

1. An elevator door device, comprising:

a car door provided in a doorway of a car of an elevator;

a safety shoe, which is provided on a leading end portion of the car door in a closing direction of the car door, and is configured to move in opening and closing directions of the car door;

a shoe switch, which is provided on the car door, and is configured to be activated when the safety shoe is moved by a certain distance set in advance in the opening direction of the car door;

a full-closure recognition switch, which is provided in the doorway of the car, and is configured to detect that the car door is brought into a fully closed state;

a failure detection vane coupled to the safety shoe;

a failure detection roller, which is provided on at least one of landings of the elevator, and is to be brought into contact with the failure detection vane when the car door is brought into the fully closed state to move the safety shoe by the certain distance in the opening direction of the car door; and a failure determiner to determine whether operation failure of the safety shoe has occurred based on a result of detection by the full-closure recognition switch and on whether the shoe switch is activated when the car has landed on one of the landings of the elevator, the failure determiner being configured to:

set a floor of a landing in which the failure detection roller is mounted as an OFF-failure detection floor for detecting OFF failure of the safety shoe;

set a floor of a landing other than the landing in which the failure detection roller is mounted as an ON-failure detection floor for detecting ON failure of the safety shoe;

detect whether the safety shoe has the OFF failure when the car has landed on the OFF-failure detection floor; and detect whether the safety shoe has the ON failure when the car has landed on the ON-failure detection floor.

2. The elevator door device according to claim 1, wherein, when the car has landed on the OFF-failure detection floor, in a case where the full-closure recognition switch detects that the car door is brought into the fully closed state and the shoe switch has failed to be activated, the failure determiner determines that the safety shoe has the OFF failure.

3. The elevator door device according to claim 2, wherein the OFF-failure detection floor includes at least one of a bottom floor or a top floor.

4. The elevator door device according to claim 3, wherein, when the car has landed on the ON-failure detection floor, in a case where the full-closure recognition switch detects that the car door is brought into the fully closed state and the shoe switch is activated, the failure determiner determines that the safety shoe has the ON failure.

5. The elevator door device according to claim 2, wherein, when the car has landed on the ON-failure detection floor, in a case where the full-closure recognition switch detects that the car door is brought into the fully closed state and the shoe switch is activated, the failure determiner determines that the safety shoe has the ON failure.

6. The elevator door device according to claim 1, wherein, when the car has landed on the ON-failure detection floor, in a case where the full-closure recognition switch detects that the car door is brought into the fully closed state and the shoe switch is activated, the failure determiner determines that the safety shoe has the ON failure.

* * * * *